United States Patent [19]

Hofmann et al.

[11] Patent Number: 4,461,141

[45] Date of Patent: Jul. 24, 1984

[54] OPENING DEVICE FOR AN OPEN-END SPINNING APPARATUS

[75] Inventors: Eberhard Hofmann; Gottfried Schneider; Johann Pohn, all of Ingolstadt, Fed. Rep. of Germany

[73] Assignee: Schubert & Salzer, AG, Ingolstadt, Fed. Rep. of Germany

[21] Appl. No.: 471,036

[22] Filed: Mar. 1, 1983

[30] Foreign Application Priority Data

Mar. 3, 1982 [DE] Fed. Rep. of Germany ..... 3207575

[51] Int. Cl.[3] ..... D01H 7/892

[52] U.S. Cl. ..... 57/408; 19/112; 57/406

[58] Field of Search ..... 19/97, 112; 57/408–413, 406

[56] References Cited

U.S. PATENT DOCUMENTS

| | | | |
|---|---|---|---|
| 3,800,520 | 4/1974 | Schiltknecht | 57/411 |
| 3,943,690 | 3/1976 | Noguera | 57/411 |
| 4,024,699 | 5/1977 | Goldammer et al. | 57/412 |
| 4,246,745 | 1/1981 | Rehm et al. | 57/408 |

FOREIGN PATENT DOCUMENTS

| | | |
|---|---|---|
| 2423241 | 11/1975 | Fed. Rep. of Germany . |
| 2427333 | 12/1975 | Fed. Rep. of Germany . |

*Primary Examiner*—John Petrakes
*Attorney, Agent, or Firm*—Julian W. Dority

[57] ABSTRACT

An insert (3) is arranged in the interior space (10) of a housing (1) of an opening device for an open-end spinning apparatus. The insert (3) is of pot-like construction with a recess (35) provided in the base (34). The recess (35) exposes a bearing bore (18) through which a drive shaft extends for supporting the opening roller. A fixing device (41, 42) is likewise associated with the insert (3) securing its relative position to the housing. A guide element (5) introducible into the insert (3) is provided to guide the insert (3) during introduction into the housing (1) or during its removal. This has a contour corresponding to the interior space (10) of the housing (1) and one or more positioning lugs (50) on its end face opposite the base (34), corresponding to the number of the positioning cavities provided in the insert (3).

17 Claims, 4 Drawing Figures

OPENING DEVICE FOR AN OPEN-END SPINNING APPARATUS

BACKGROUND OF THE INVENTION

The present invention relates to an opening device for an open-end spinning apparatus which includes a housing. In the interior space of the housing is arranged an opening roller and an insert which accommodates the opening roller and which exhibits perforations, enclosed on all sides, which correspond to housing orifices connecting the interior space with other parts of the spinning apparatus.

It is known from German Offenlegungsschrift No. 2,427,333 to provide an insert in an opening roller housing for its protection. This insert is not elastically deformable and, therefore, only suitable for a circular construction of the housing interior space. If the interior space provided in the insert is required to be noncircular, then this is only possible by machining. The orifices provided in the insert can also be produced only by machining. However, this insert is relatively expensive to produce, has a large space requirement and also requires bulky opening roller housings.

Thin-walled foils which are stuck onto the walls opposite the circumference of the opening roller are also known from German Offenlegungsschriften Nos. 2,423,241 and 2,448,585. However, the adhesive joints cannot be released without difficulty when required. In order to avoid gluing in the foil, it is also known to tension the foil and to fix it in the tensioned state to the housing (German Offenlengungsschriften No. 2,819,060 and 2,911,158). This is done with the aid of a tensioning wedge (German Offenlegungsschrift No. 2,819,060) or of a subsequently hardenable filler (German Offenlegungschrift No. 2,911,158). In both cases, a small gap is present between the ends of the foil, on which individual fibers which have not succeeded in detaching themselves from the opening roller in the region of the fiber feed duct, can catch and accumulate. Such accumulation of fibers causes compression and tangling of these fibers. When this accumulation of fibers is subsequently torn away from the gap region by the opening roller, they enter the spinning rotor with the other fibers and form an imperfection there, or at least an irregularity in the yarn.

It is, therefore, the aim of the present invention to produce an insert for an opening device which is free from the disadvantages described but which is economical to produce, economical in terms of space and quickly exchangeable.

SUMMARY OF THE INVENTION

This aim is achieved according to the invention in that the insert is of pot-like construction with a recess in the base which exposes a bearing bore supporting the opening roller, while a fixing device securing the position of the insert relative to the housing is associated with said insert. Because the insert is of pot-like construction, it exhibits, with the exception of the technologically dictated perforations, no edges on which fibers can catch temporarily. The danger of faults resulting from this is thus eliminated. The fixing device, which secures the relative position between insert and housing, is provided to prevent the insert from being rotated in the opening roller housing by the fiber/air stream rotating in the housing.

Apart from the rotating fiber/air stream, fibers in the region of the perforations, attaching themselves to the edges of the latter, influence the insert in the tangential direction and can cause rotation of the insert.

The fixing device may be constructed in various ways and possibly be constructed as a tight fit between housing and insert. On the other hand, a better fixing of the insert in the peripheral direction can be achieved by a noncircular construction of the housing interior space. A preferred rotational fixing, which is particularly economical to produce, is achieved according to the invention in that, although the interior space of the housing is circular, the bearing bore is surrounded by an annular shoulder, the external contour of which exhibits the same diameter as the recess in the base of the insert and is arranged eccentrically to the interior space to the same degree as the said recess. A reliable securing of the insert against rotation is again achieved by this arrangement allowing the recess to snugly contact the annular shoulder surrounding the bearing bore.

The removal of the insert from the housing is possible by hooking a tool into the perforations in the insert. To permit the insert to contact the contours of the interior space optimally, it exhibits only a very small thickness. There is thus a danger of the tool slipping. For this reason, according to a further development of the object of the invention, at least two bores are preferably provided in the end wall of the housing, distributed uniformly about the bearing bore. These bores permit the insert to be influenced from the side remote from the open side of the housing in order to eject it while skewing of the insert during ejection is prevented by the uniform distribution of the two or more bores in the housing end wall. These bores may also be used for the securing of the insert against rotation, in that, according to a further feature of the invention, at least two guide pins attached to the outside of the base of the insert are provided corresponding to the number of bores in the housing end wall and engage into the bores in the end wall of the housing when the insert is inserted into the housing. These guide pins may furthermore also be used for the axial fixing of the insert in that the guide pins extend to the outside of the housing when the insert is inserted and exhibit screwthreads to accommodate locknuts in their region located outside the housing.

Whereas a finite band can still be positioned without difficulty even after the introduction into the housing, this is not the case with a pot-like insert. In order to permit, here again, a simple positioning of the insert at the correct angle, at least one positioning cavity is provided in the base of the insert on the circumference of the recess provided for the axis of the opening roller. This positioning cavity serves to accommodate the tool so that by an appropriate orientation of this tool, the insert is also correctly positioned. On the other hand, however, such a positioning cavity also permits an accurate orientation of the insert at the correct angle by means of a mark provided on the end face of the housing interior space.

The insert preferably fits in the interior space of the housing with relatively close tolerances, so that the intervals between the points of the opening roller clothing and the interior wall of the insert are reliably prevented from being modified by swinging movements, and from thereby creating uncontrollable conditions in the region of the opening roller. The insertion of the insert into the housing can be substantially improved by a guide element introducible into the insert, which exhibits a contour corresponding to the interior space of the housing, and also one or more positioning lugs provided on its end face opposite the base corresponding to the number of the positioning cavities provided in the insert, and which, by engaging into the positioning cavity, retains and secures the insert in the correct angular position even during the insertion into the interior space of the housing.

This guide element is also a valuable aid in the removal of an insert from the housing. The guide element introducible into the insert therefore preferably exhibits, in alignment with the recess provided in the insert and with the bearing bore provided in the housing, a bore adapted in diameter to this recess and to this bearing bore to accommodate an insert traction device or an insert ejection device. The introduction of the insert into the housing and the ejection of the insert out of the housing are considerably simplified by such devices.

According to a preferred embodiment, the insert ejection device exhibits an insert ejection element which is guided in the bearing bore of the housing and exhibits bolts which can be brought to act on the insert through the bores provided in the end face of the housing. In an advantageous development of this case, the insert ejection device has a bracing device braced against the housing on the open side outside the interior space, which bracing device encloses a space sufficient to accommodate the guide element totally. The insert ejection device also has a cylindrical section guiding the guide element and a section reduced in diameter relative to the said section with a male screwthread to accommodate the insert ejection element exhibiting a smooth bore and an adjusting nut braced against the insert ejection element on the side remote from the housing. The insert ejection device is fixed relative to the housing in the axial direction by the bracing device, so that by tightening the adjusting nut, the insert ejection element with its bolt is brought into abutment against the base of the insert and is pressed out of the interior space of the housing.

For a reliable and simple introduction of the insert into the housing, it is advantageously provided that the depth of the bearing bore is greater than the depth of the interior space of the housing and further that the insert traction device essentially consists of a bolt with three different sections graduated in diameter. Of these sections, the first section is greater in diameter than the bore of the guide element and serves as bracing means for the insert traction device on the guide element. The second section corresponds to the diameter of the bore in the guide element and extends into the bearing bore of the housing at the commencement of the introduction of the insert with the guide element located therein. Finally, the third section, which has the smallest diameter, exhibits a male screwthread to accommodate a bracing washer braced against the outside of the housing and an adjusting nut, while this section extends outside the housing at the commencement of introduction of the insert into the housing and still extends into the bearing bore of the housing when the insert is fully introduced into the interior space of the housing. The central section serves to guide the insert traction device, whereas, the adjusting nut, when tightened, draws the guide element with the insert into the interior space of the housing with the aid of the bracing washer.

The insert is deformed by the guide element so that it assumes exactly the external shape of the housing interior space. However, the danger then exists that due to the stresses thereby generated in the insert, the latter may catch by the side edge of its perforations against the front edge of the housing interior space and thus cause damage to the insert. There is also the further danger that the interior space of the housing may be damaged, since this is customarily produced from a zinc alloy or aluminum alloy, which are known to be relative soft compared with other metals. To avoid this danger, it is preferably provided that the interior space of the housing is surrounded on its open end face by a centering shoulder to brace a guide ring of great hardness applicable herewith, the width of which substantially corresponds to the depth of the insert, and the internal contour of which on its side opposite the housing corresponds to the contour of the interior space of the housing, whereas, it widens slightly on its side remote from the housing. The widening preferably merges without an edge into the constant cross-section opposite the interior space of the housing.

In order to permit a correct angular orientation of the guide element and/or of the quide ring in a simple manner, it is advantageous if these elements exhibit a positioning aid on their side remote from the base of the insert. For example, corresponding marks on these elements and on the housing are sufficient for this purpose. However, a development of the subject of the invention, according to which the positioning aid is constructed as cooperating guide surfaces on the guide element and/or on the guide ring and on the housing outside its interior space is particularly convenient. It is advantageous if the guide surfaces are constructed as a bolt and a bore guiding the bolt while the bolt is preferably arranged on the housing and serves to guide both the guide element and also the guide ring.

BRIEF DESCRIPTION OF THE DRAWINGS

Further particulars of the invention are explained more fully with reference to the accompanying drawings wherein.

DESCRIPTION OF A PREFERRED EMBODIMENT

Figure 1:
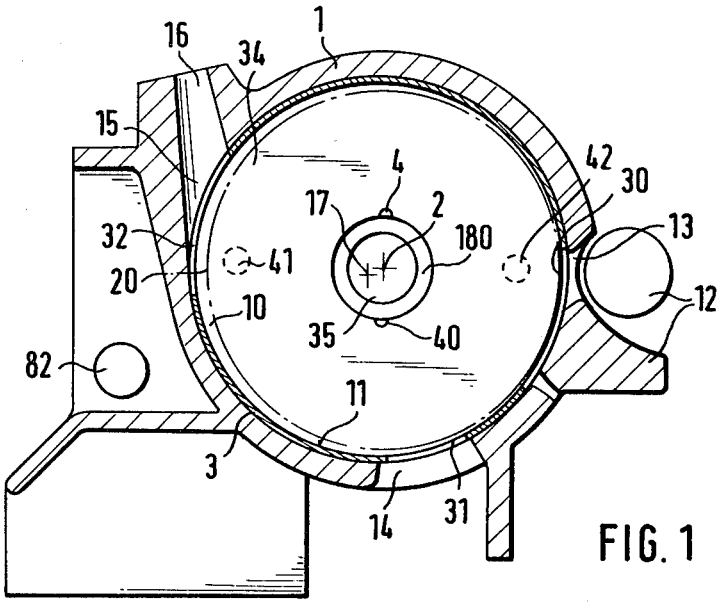
FIG. 1 shows, in side elevation, a first embodiment of the opening device according to the invention with a housing exhibiting a circular interior space and a bearing bore provided eccentrically thereto.

FIG. 1 shows a housing 1 of an opening device, in the interior space 10 of which an opening roller, shown only by indicating its clothing points 20, is arranged during service. The sliver for spinning is fed to this opening roller in known manner by means of a delivery device 12, for which purpose a housing orifice 13 connecting the interior space 10 to the delivery device 12 is provided in the wall 11 surrounding the opening roller. In the exemplary embodiment illustrated, a further housing orifice 14, which serves to segregate dirt contained in the fibrous material, is provided downstream of the housing orifice 13 in the fiber transport direction. Finally, downstream of this housing orifice 14, yet a third housing orifice 15 provided, which is ajoined by a fiber feed duct 16 leading to the open-end spinning element, not shown. In order to facilitate the separation of the fibers from the opening roller, an interval which is widened compared with the remaining peripheral region of the opening roller, is provided between the clothing points 20, indicated by dash lines, of the opening roller and the wall 11 surrounding the opening roller.

According to FIG. 1, the interior space 10 has a circular shape. The widened interval referred to is obtained by the fact that the axis 2 of the opening roller does not coincide with the center 17 of the interior space 10, but exhibits a greater interval from the region upstream of the housing orifice 15.

The housing 1, which generally consists of a nonferrous metal casting, preferably produced by a diecasting process or pressure-casting process in aluminum or zinc or an alloy with these metals as the main constituent, therefore, consists of a relatively soft material. Furthermore, in the case of a mechanical treatment of the surfaces adjoining the interior space 10, there is the danger of blowholes being exposed, which form a discontinuity in the fiber transport path and lead to faults in the formation of the yarn.

In order to protect the soft housing wall surfaces to cover any possible blowholes and also to improve the segregation of dirt, if present, and the fiber separation by partial masking of the housing orifices 14, if present, and 15, an insert 3 is, therefore, provided in the interior space 10 of the housing 1. This insert 3 consists of thin sheet material and exhibits a pot-like shape, which is produced by deep-drawing, pressing or another plastic shaping process. Perforations 30, 31 and 32 enclosed on all sides are provided in this insert 3 in correspondence with the housing orifices 13, 14 and 15. These perforations 30, 31 and 32 in the insert 3 are produced by punching from the inside outwards.

The insert 3, which exhibits a peripheral wall 33 and a base 34 (see also FIGS. 3 and 4) has in its base 34 a recess 35, through which the drive shaft of the loosening roller is passed in the service state. This recess 35 may be of different sizes; the minimum size corresponds to the diameter of the drive shaft of the opening roller. However, the recess may also be significantly larger. It is merely required to provide a sufficiently large radial base surface so that the insert 3 is given good rigidity and can be installed into and removed from the housing 1 in a simple manner.

As described, the axis of the opening roller and hence also its drive shaft is arranged eccentrically to the interior space 10 of the housing 1. The bearing bore 18 is surrounded by a concentric annular shoulder 180, which is hence also arranged eccentrically to the interior space 10. This annular shoulder exhibits only such a small height that it does not overhang the base 34 towards the opening roller when the insert 3 is inserted. The recess 35 in the base 34 of the insert 3, which is adapted in diameter to the diameter of this annular shoulder 180, is also provided with equal eccentricity to that of the annular shoulder 180 to the interior space 10. Because the insert 3 is produced with relatively small tolerances to the interior space 10 of the housing 1, when the opening roller is mounted there is absolutely no danger of the insert 3 being rotated relative to the interior space 10 of the housing 1 by the tangential forces acting during the opening work, so that a fixing of the insert 3 in the housing 1 is achieved by the eccentric arrangement of the annular shoulder 180.

Two diametrically opposite positioning cavities 4 and 40 are provided in the base 34 of the insert 3 on the circumference of the recess 35. These positioning cavities 4 and 40 have the function of ensuring the insertion of the insert 3 at the correct angle into the housing 1, and the monitoring of the position of the insert 3 relative to the housing 1 during insertion. For this purpose, for example, the housing 1 is provided with a mark in the region of the positioning cavities 4 and 40, as shown in the region of the positioning cavity 4 in FIG. 1.

The opening of the sliver fed to the opening roller via the deliver device 12 occurs in manner known per se. Thread accumulations and resulting flaws in the yarn and thread breakages are prevented by the peripheral surface of the insert 3, which exhibits no interruptions apart from the technologically necessary perforations 30, 31 and 32. The eccentric mounting of the opening roller relative to the interior space 10 and to the insert 3 fixes the insert 3 in its existing rotational position without the necessity to provide excessively tight fits between insert 3 and housing 1. This eccentric mounting of the opening roller is thus not only to be considered, in the case of a recess 35, the diameter of which corresponds to that of the drive shaft of the opening roller, as a passage orifice for the drive shaft, but simultaneously forms with the annular shoulder 180 a fixing device with regard to the rotational position of the insert 3.

If desired, the opening roller may also be arranged concentrically to the interior space 10 and the rotational fixing of the insert achieved in that only the external contour of the annular shoulder 180 is arranged eccentrically to the interior space 10.

Figure 2:
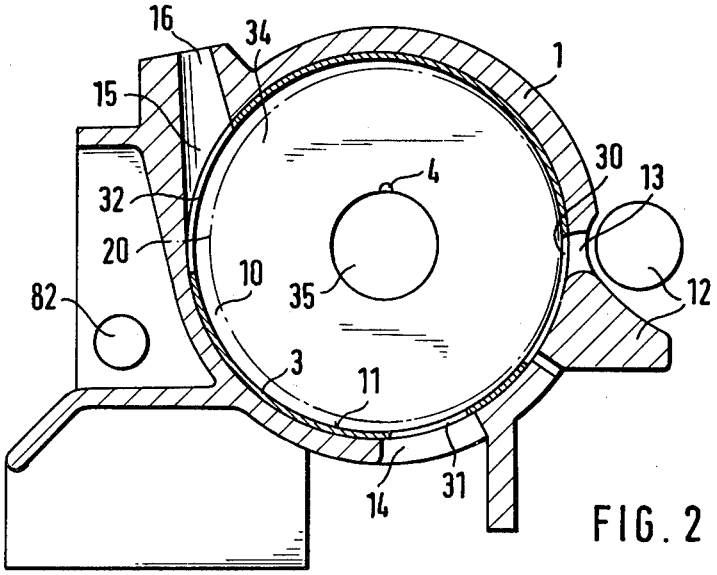
FIG. 2 shows, in side elevation, a variant embodiment of the invention with noncircular interior space.

FIG. 2 shows an analogous construction of the loosening device to FIG. 1. However, in this embodiment, the fixing of the insert 3 in its existing rotational position occurs by a noncircular construction of the interior space 10 to the cross-sectional shape of which the insert 3 is adapted. Thus, here again, no variation in the rotational position of the insert 3 is possible. Moreover, FIG. 2 shows that even a single positioning cavity 4 is sufficient for the insertion of the insert 3 at the correct angle.

In order to remove the insert 3 from the interior space 10 of the housing 1, it is possible to hook with a tool behind one or more of the side edges of the perforations 30, 31 and 32, perhaps even alternately, and to extract the insert from the housing in this way. It is also possible to provide corresponding depressions in the end wall 19 of the housing 1 in the region of the positioning cavities 4 and 40 so that a tool can engage behind the base 34 of the insert 3 at this point.

Figure 3:
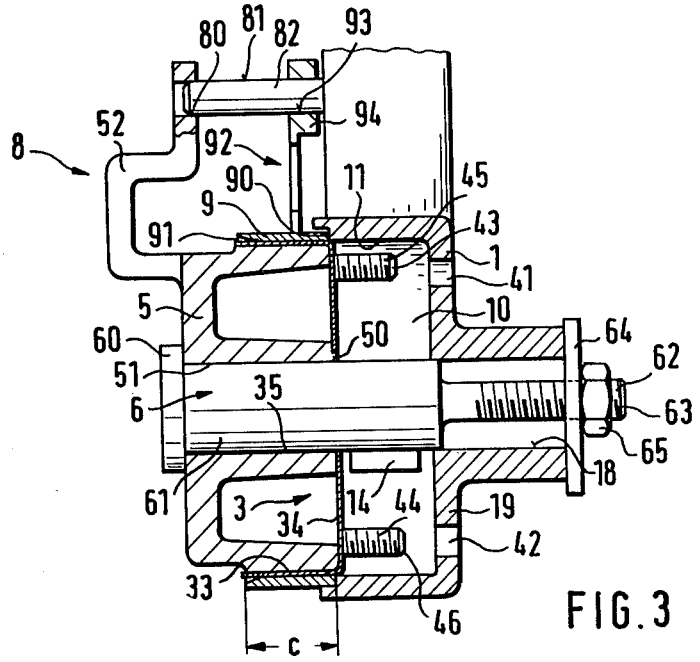
FIG. 3 shows, in cross-section, the opening device constructed according to the invention during the introduction of the insert.

FIG. 3 shows a further development of the opening device with another possibility for the rotational fixing of the insert 3. In this figure, which shows the opening device from above in cross-section, omitting the delivery device 12 and the housing orifice 13, it will be seen that that part of the housing 1 which contains the bearing bore 18 to accommodate the drive shaft of the opening roller, is prolonged backwards. At least two bores 41 and 42 are present in the end wall 19 of the housing 1 distributed uniformly about the interior space 10 of the housing 1. In corresponding manner, two guide pins 43 and 44 are arranged distributed about the recess 35 in the insert 3 (see FIGS. 1 and 2) and have such a length that they engage into the bores 41 and 42 in the end wall 19 of the housing 1 when the insert is correctly introduced into the housing. By this means, the inserted insert 3 can be securely prevented from rotating relative to the housing 1 even if the interior space 10 of the housing 1 is circular and the insert 3 is arranged concentrically to this interior space 10; that is to say, if the widened interval between opening roller and wall is omitted. It is not necessary for this purpose for the base 34 of the insert 3 to extend as far as the drive shaft of the opening roller, but it is sufficient if it engages sufficiently far behind the opening roller to give the insert 3 the desired rigidity and can accommodate the guide pins 43 and 44.

In order to secure the insert 3 not only in the rotational direction, but also axially in the housing 1, the guide pins 43 and 44 may exhibit such a length that they extend through the bores 41 and 42 to the outside of the housing 1 and exhibit at least on that partial region located outside the housing 1 a screwthread 45 or 46 onto each of which a locknut (not shown) may be screwed.

These bores 41 and 42 also facilitate extraordinarily the removal of the insert 3, because by a gentle tapping or by pressing on a tool which is placed on the guidepins, or, if these are not provided, directly on the insert 3, from outside the housing 1, the insert 3 can be pressed out of the housing 1.

FIG. 3 shows a guide element 5 which considerably facilitates the introduction of the insert 3 into the interior space 10 of the housing 1. This guide element 5 has a contour corresponding to the interior space 10 of the housing 1, and corresponding to the number of positioning cavities 4 and 40 on the base 34 of the insert 3, one or more positioning lugs 50 which engage in the positioning cavity 4. A considerably greater play is provided between the positioning element 5 and the insert 3 than between the insert 3 and the wall 11 of the housing 1 where a force fit is provided. The introduction of the guide element 5 into the insert 3 thus proceeds without any difficulty although the guide element 5 brings the insert 3, which has been slightly deformed during the punching of the perforations 30, 31 and 32 to the desired shape. The insert 3 is given considerable play for formal adaptation transversely to the stretching direction to enable the insert 3 to adapt itself to the shape of the guide element 5.

When the insert 3 has been introduced into the interior space 10 of the housing 1 with the aid of the guide element 5, the guide element 5 can also be removed again from the insert 3 without any difficulty, which is retained due to the closer fit in the housing 1.

Figure 4:
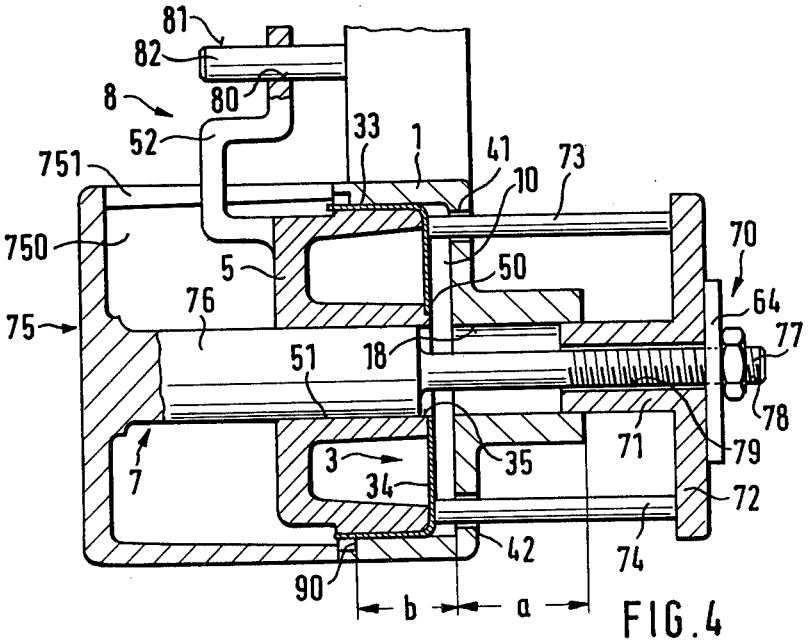
FIG. 4 shows, in cross-section, the subject of the invention during the ejection of the insert.

In order to simplify further the ejection or introduction of the insert 3 from or into the housing 1, the guide element 5 according to FIGS. 3 and 4 has in alignment with the recess 35 provided in the insert 3 a bore 51 adapted to the latter—and hence also to the bearing bore 18 of the housing 1—for the selective accommodation of an insert traction device 6 or of an insert ejection device 7.

The insert traction device 6 is illustrated in FIG. 3. It consists substantially of a bolt which is inserted into the bore 51 of the guide element 5. This bolt has three graduated sections 60, 61 and 62. The first section 60, largest in diameter, serves as a bracing means for the insert traction device 6 on that side of the guide element 5 remote from the end wall 19. The second section 61 is matched in diameter to the inside diameter of the bore 51 and exhibits such a length that it already projects into the bearing bore 18 of the housing 1 at the commencement of introduction of the insert 3 into the interior space 10 of the housing 1. Finally, the third section 62 is the smallest section in diameter. This third section 62 has such a length that it already extends through the bearing bore 18 to the outside of the housing 1 and its bearing bore 18 in the abovementioned position of the insert 3 and hence also of the guide element 5 and of the insert traction device 6 at the commencement of the introduction of the insert into the interior space 10 of the housing 1. The section 62 has a male screwthread 63, onto which an adjusting nut 65 can be screwed with interposition of a bracing washer 64.

In order to introduce the insert 3 into the interior space 10 of the housing 1, the guide element 5 with the insert 3 slipped over it is brought up to the open side of the housing 1 while the section 62 and the end of the section 61 opposite this section 62 project into the bearing bore 18. The bracing washer 64 is pushed onto the male screwthread 63 of the free end of the section 62 projecting onto the outside of the bearing bore 18 and the adjusting nut 65 is screwed on. When the adjusting nut 65 is tightened, the guide element 5 previously oriented at the correct angle is drawn with the insert 3 progressively into the interior space 10 of the housing 1 while the section 61 ensures good guidance of the insert traction device 6 in the bearing bore 18. The male screwthread 63 exhibits such a length that it still extends into the bearing bore 18 even when the insert 3 is fully introduced into the housing 1, because this is the only way in which it is possible to complete this introduction movement with the aid of the adjusting nut 65. For this purpose, the depth (a) of the bearing bore 18 is chosen greater than the depth (b) of the interior space 10 of the housing 1 (see FIG. 4). When the insert 3 has reached its limit position, after slackening the adjusting nut 65, the insert traction device 6 is withdrawn from the guide element 5 which is now, in turn, removed from the insert 3.

A perfect orientation of the insert 3 in the housing 1 can be ensured by a positioning mark (not shown) on the underside of the insert 3 (for example paint marks or the guide pins 43 and 44) and by the bores 41 and 42.

In order to permit this orientation in an even simpler manner, according to FIG. 3, a positioning aid 8 is provided on the guide element 5 on its side remote from the base 34 of the insert 3. This positioning aid 8 consists in the simplest case of a notch or the like, which is brought into a specific relative position to a conspicuous point of the housing 1. This positioning aid 8 is provided on the guide element 5 so that the insert 3 occupies the desired angular position to the interior space 10 for a corresponding alignment of the guide element 5 to the housing 1. In order that the positioning aid 8 effects a positive adjustment of the angular position of the insert 3, the angular position of which relative to the guide element 5 is ensured by the positioning cavity 4 and the guide lug 50, relative to the interior space 10, the positioning aid 8 according to FIG. 3 is constructed as cooperating guide surfaces 80 and 81 on the guide element 5 and on the housing 1 outside its interior space 10. In the embodiment illustrated in FIG. 3, these guide surfaces 80 and 81 are formed by a bore in a jib arm 52 attached to the guide element 5 and by a bolt 82 which is attached to the housing 1 at a suitable point.

Due to the stresses to which the insert 3 is subject when it is pressed by the guide element 5 into a shape adapted to the interior space 10, it may occur that the external contours of the insert 3 in the proximity of the base 34 and in the proximity of its open edge differ slightly from each other and hence also from the cross-sectional shape of the interior space 10 of the housing 1. This, however, may give rise to the danger of the insert 3 catching, particularly by the side edges of its perfrations 30, 31 and 32, on the outer edge of the interior space 10 of the housing 1. This, however, also involves the danger of damage, both to the insert and to the housing 1. In order to avoid this danger, according to FIG. 3, the interior space 10 is surrounded on the open end face of the housing 1 by a centering shoulder 90, into which a guide ring 9 of great hardness is insertible in order to introduce the insert 3 into the interior space 10 of the housing 1. The guide ring 9 has a width (c) which corresponds substantially to the depth of the insert 3 and hence also to the depth (b) of the interior space 10 of the housing 1. The guide ring 9 has on its side opposite the housing 1 a cross-sectional shape which corresponds to the cross-sectional shape of the interior space 10 of the housing 1, whereas it widens slightly on its side remote from the housing 1.

The insertion of the insert 3 into the housing 1 proceeds as follows:

The insert 3 produced and shaped by deepdrawing or a similar process, and having been slightly deformed by the punching of the perforations 30, 31 and 32, is restored to its desired shape by pushing it over the guide element 5. The guide ring 9 is then placed upon the centering shoulder 90 of the housing 1. The guide element 5 with the insert 3 is then pushed into the guide ring 9 until the male screwthread 63 of the section 62 of the insert traction device 6 projects out of the bearing bore 18. After placing the bracing washer 64, the insert 3 is drawn progressively into the interior space 10 by screwing on and tightening the adjusting nut 65 while the adjusting nut 65 is braced against the housing 1 with the aid of the bracing washer 64, and the section 60 of the insert traction device 6 is braced against the guide element 5. Due to the widened part 91, which merges gradually, so far as possible without an edge, into the constant cross-section opposite the interior space 10 of the housing 1, any damage to the insert 3 during introduction into the guide ring 9 is avoided. Because initial cross-section of the guide ring 9 aligned with the interior space 10 of the housing 1 is adapted precisely to the cross-section of the interior space 10, the penetration of the insert 3, leaving the guide ring 9, into the interior space 10 involves no difficulty or danger of damage whatsoever.

As for the guide element 5, according to FIG. 3, a positioning aid 92 is also provided for the guide ring 9. This—like the positioning aid 8 for the guide element 5—may be of varying construction. According to FIG. 3, here again cooperating guide surfaces are provided which are constructed in the embodiment shown as a bore 93 which is provided in a jib arm 94 attached to the guide ring 9, and as the bolt 82. Because the bolt 82 is arranged on the housing 1, it can assume the function of guidance and orientation both of the guide element 5 and of the guide ring 9.

It is also possible to construct the insert traction device otherwise than as described. For example, the adjusting nut 65 may be constructed integrally with the bracing washer 64 and furthermore exhibit a cylindrical lug projecting into the bearing bore 18, which lug secures this integrated part radially in the bearing bore. A screwthreaded bore is then provided in this integrated part into which another element can be screwed which consists substantially of a combination of the sections 60 and 61 shown in FIG. 3. An introduction of the insert 3 into the interior space 10 of the housing is also possible in a simple manner with the aid of such an insert traction device. Other constructions are possible, for example, in that an adjusting nut directly influences the guide element, while that part of the insert traction device 6 which is immobile during the adjustment is braced against the bearing bore 18 of the housing 1 and exhibits a male screwthread on its end confronting the guide element 5.

The positioning aid 8 may also be constructed differently. Even if bolts and bores are adopted for this purpose, constructions other than those illustrated are possible. Thus mutually independent positioning aids 8 may be provided for the guide element 5 and the guide ring 9. However, the construction shown with a bolt 82 arranged on the housing 1 and with guide surfaces 80 and 93 constructed as bores on the guide element 5 and on the guide ring 9 is particularly space-saving. However, such a bolt may also be provided on the jib arm 52 of the guide element 5 while the guide surfaces of the guide ring 9 and of the housing 1 cooperating therewith are then constructed as bores.

As already explained previously, it is possible to use an insert ejection device 7 to expel the insert 3 from the interior space 10 of the housing 1. In the simplest embodiment, which will be explained first of all with reference to FIG. 4, this insert ejection device 7 consists of an insert ejection element 70 which has a cylindrical guide section 71, a retaining yoke 72, and two or more bolts 73, 74 corresponding to the number of bores 41, 42 in the end wall 19 of the housing 1.

In order to force the insert 3 out of the interior space 10 of the housing 1, the guide section 71 of the insert ejection element 70 is introduced into the bearing bore 18 of the housing 1 while simultaneously the bolts 73 and 74 are introduced into the bores 41 and 42 in the end wall 19 of the housing 1 until they come into abutment with the insert 3. By exerting a force upon the insert ejection element 70, possibly in the form of light taps, the insert 3 is forced out of the interior space 10 of the housing 1.

If the insert 3 is attached to the housing 1 by means of guide pins 43 and 44 provided with screwthreads 45 and 46, an analogous procedure is adopted. Obviously, the nuts must first of all be unscrewed from the guide pins 43 and 44, whereupon the bolts 73 and 74 are brought to bear upon the guide pins 43 and 44. In order to prevent the bolts 73 and 74 from slipping laterally from the guide pins 43 and 44, the latter may exhibit correspondingly cooperating shapes, for example, in the form of a cone and of a corresponding hollow cone.

In order to simplify the expulsion of the insert 3 and make it getle, it is likewise provided in the embodiment shown in FIG. 3 that a force is exerted upon the insert ejection element 70 through a screw device. This screw device is a constituent of a bracing device 75 which is braced against the open side of the housing 1 outside its interior space 10 from where a cylindrical section 76 extends into the bore 51 of the guide element 5 in order to guide the latter during the expulsion of the insert 3 from the housing 1. The cylindrical section 76 is continued in a further section 77 which is reduced in diameter compared with the section 76 and exhibits a male screwthread 78. The insert ejection element 70 has a smooth bore 79 of such diameter that it can be pushed unobstructedly into the bearing bore 18 of the housing 1 while the section 78 extends to that side of the insert ejection element 70 remote from the housing 1. The bracing washer 64 is placed on this free end and the adjusting nut 65 is screwed on, so that by tightening the adjusting nut 65, the bolts 73 and 74 can act on the insert 3 through the bores 41 and 42. In order to make it possible for the insert 3, together with the guide element 5 introduced previously, to leave the interior space 10 of the housing 1, the bracing device 75 surrounds a space 750 which exhibits such a depth that it can fully accommodate the guide element 5 with the insert 3 when expelled from the interior space 10. If a jib arm 52 is provided for the accommodation of the said bolt 82 as a positioning aid 8, the bracing device 75 has an axial slot 751 in which this jib arm 52 is guided during the axial movement of the guide element 5.

The insert ejection device 7 may also be constructed differently, in that the insert ejection element 70 forms an integral constituent of the section 76 upon which the bracing device 75 is slidably guided. That end of the insert ejection element 70 opposite the bracing device 75 then has a male screwthread to accommodate an adjusting nut which acts on the outside of the bracing device. Here again, the fact that the bracing device 75 is braced against the housing 1, has the result that the insert ejection element with its bolts 73 and 74 acts on the insert 3 and forces the latter into the space 750 of the bracing device 75 when the adjusting nut is tightened.

The insert 3 as above described is simple and inexpensive to produce. By an appropriate treatment (for example, heat treatment, coating), the layers coming into contact with the fibers can be given high wear resistance and hence have a relatively long useful life. Because the insert 3—although thin-walled—is substantially fixed in its shape, it is unnecessary to combine the fixing device with a tensioning device which adapts the insert 3 to the interior space 10. This also facilitates the exchange of the insert 3 so that this proceeds without difficulty and can be performed anywhere within a very short time. Even if tight fits are provided between insert 3 and wall 11 of the interior space 10 of the housing 1, with the described construction of the opening device and of the insert traction device 6 and of the insert ejection device 7, an exchange of the insert 3 can be performed with economy of time even by unskilled labor, while the advantages known from previous inserts are likewise achieved.

While a preferred embodiment of the invention has been described using specific terms, such description is for illustrative purposes only, and it is to be understood that changes and variations may be made without departing from the spirit or scope of the following claims.

What is claimed is:

1. An insert for an opening device for an openend spinning apparatus, said spinning apparatus including a housing having a substantially cylindrical interior space therein, orifices connecting said interior space with other parts of said spinning apparatus, an opening roller carried in said interior space of said housing, a drive shaft extending outwardly from said opening roller through a bearing bore provided in said housing, an insert carried in said interior space surrounding said opening roller, perforations provided in said insert which correspond to said orifices, the improvement comprising:

said insert being a pot-like construction including, (i) a peripheral wall;

(ii) a base joining said peripheral wall, and (iii) a recess provided in said base in alignment with said drive shaft of said roller extending through said bearing bore, and a fixing device securing the position of said insert relative to said housing.

2. The opening device as claimed in claim 1, wherein the interior space (10) is circular and the bearing bore (18) is surrounded by an annular shoulder (180), the external contour of which exhibits the same diameter as said recess (35) in the base (34) of the insert (3) and is arranged eccentrically to the interior space (10) to the same degree as the said recess (35).

3. The opening device as claimed in claim 1, having at least two bores (41, 42) in the end wall (19) of the housing (1), distributed uniformly about the bearing bore (18).

4. The opening device as claimed in claim 3, having at least two guide pins (43, 44) attached to the outside of the base (34) of said insert (3), which engage into the bores (41, 42) in the end wall (19) of the housing (1) when the insert (3) is inserted into the housing (1).

5. The opening device as claimed in claim 4, wherein the guide pins (43, 44) extend to the outside of the housing when the insert (3) is inserted and exhibit screwthreads (45, 46) to accommodate locknuts in their region located outside the housing (1).

6. The opening device as claimed in claim 1 wherein at least one positioning cavity (4, 40) is provided on the circumference of said recess (35).

7. The opening device as claimed in claim 6, having a guide element (5) introducible into said insert (3), which exhibits a contour corresponding to the interior space (10) of the housing (1), and also one or more positioning lugs (50) provided on its end face opposite said base (34) corresponding to the number of the positioning cavities (4, 40) provided in the insert (3).

8. The opening device as claimed in claim 7, wherein the guide element (5) exhibits, in alignment with the recess (35) provided in the insert (3), a bore (51) adapted in diameter to the same to accommodate an insert traction device (6) or an insert ejection device (7).

9. The opening device as claimed in claim 8 wherein said insert ejection device (7) exhibits an insert ejection element (70) which is guided in the bearing bore (18) of the housing (1) and exhibits bolts (73, 74) which can be brought to act on the insert (3) through the bores (41, 42) of the end face (19) of the housing (1).

10. The opening device as claimed in claim 9, wherein said insert ejection device (7) exhibits a bracing device (75) braced against the housing (1) on the open side outside the interior space (10) which bracing device encloses a space (750) sufficient to accommodate the guide element (5), a cylindrical section (76) guiding the guide element (5) and a section (77) reduced relative to the said section (76) with a male screwthread (78) to accommodate the insert ejection element (70) exhibiting a smooth bore (79) and an adjusting nut (65) to be brought to act on the insert ejection element (70) on the side remote from the housing (1).

11. The opening device as claimed in claim 8 wherein the depth (a) of the bearing bore (18) is greater than the depth (b) of the interior space (10) of the housing (1) and wherein further the insert traction device (6) essentially consists of a bolt with three sections (60, 61, 62) graduated in diameter, of which the first section (60) is greater in diameter than the bore (51) of the guide element (5) and serves as bracing means on the guide element (5), the second section (61) corresponds to the diameter of the bore (51) in the guide element (5) and extends into the bearing bore (18) of the housing (1) at the commencement of the introduction of the insert (3) into the housing (1), and the third (62) of smallest diameter exhibits a male screwthread (63) to accommodate a bracing washer (64) braced against the outside of the housing and an adjusting nut (65) while this section (62) extends outside the housing (1) at the commencement of introduction of the insert (3) and still extends into the bearing bore (18) when the insert (3) is fully introduced into the interior space (10) of the housing (1).

12. The opening device as claimed in claim 7, wherein the interior space (10) of the housing (1) is surrounded on its open end face by a centering shoulder (90) to brace a guide ring (9) of great hardness applicable here, the width (c) of which substantially corresponds to the depth of the insert (3), and the internal contour of which on its face opposite the housing (1) corresponds to the contour of the interior space (10) of the housing (1), whereas it widens slightly on its side remote from the housing (1).

13. The opening device as claimed in claim 12, wherein the widening (91) in the guide ring (9) merges without an edge into the constant cross-section opposite the interior space (10) of the housing (1).

14. The opening device as claimed in claim 7 wherein the guide element (5) and/or the guide ring (9) exhibits a positioning aid (8) on its side remote from the base (34) of the insert (3).

15. The opening device as claimed in claim 14, wherein the positioning aid (8) is constructed as cooperating guide surfaces (80/81) on the guide element (5) and/or on the guide ring (9) and on the housing (1) outside its interior space (10).

16. The opening device as claimed in claim 15, wherein the guide surfaces (80, 81) are constructed as a bolt (82) and a bore guiding the bolt (82).

17. The opening device as claimed in claim 16 wherein the bolt (82) is arranged on the housing (1) and serves to guide both the guide element (5) and also the guide ring (9).

* * * * *